United States Patent [19]

Brands

[11] Patent Number: 4,566,162

[45] Date of Patent: Jan. 28, 1986

[54] STRETCHER/EXPANDER ROLLER

[75] Inventor: George Brands, Wilmette, Ill.

[73] Assignee: American Roller Company, Union Grove, Wis.

[21] Appl. No.: 660,261

[22] Filed: Oct. 15, 1984

Related U.S. Application Data

[63] Continuation of Ser. No. 436,842, Oct. 26, 1982, abandoned.

[51] Int. Cl.[4] ..... D06C 3/06

[52] U.S. Cl. ..... 26/105; 242/56.5; 29/121.4

[58] Field of Search ..... 26/105; 242/56.5; 29/121.4, 121.6, 127

[56] References Cited

U.S. PATENT DOCUMENTS

| | | | |
|---|---|---|---|
| 924,595 | 6/1909 | Birch | 26/105 |
| 1,568,401 | 1/1926 | Griffith | 26/105 X |
| 2,717,037 | 9/1955 | Goodwillie | 242/56.5 |
| 2,721,739 | 10/1955 | Mursch et al. | 29/122.6 X |
| 3,405,855 | 10/1968 | Daly et al. | 26/105 |

FOREIGN PATENT DOCUMENTS

| | | | |
|---|---|---|---|
| 1275100 | 5/1972 | United Kingdom | 26/105 |
| 493532 | 4/1976 | U.S.S.R. | 29/121.4 |

OTHER PUBLICATIONS

Chase, et al., "Flexible Roller for Spreading Webs", Research Disclosure, No. 177, 01/79, S 9052 0025.

"Flex Spreader—Never Pitches You a Curve", Samuel Bingham Co., Chicago, Ill.

"Wrinkle Problems? Cure Your Continuous Wrinkle Problems with a Bingham Mark II Flex Spreader Roll", Paper Film and Foil Converter, 11/1975.

"Arco Stretcher—Because Nobody Likes a Wrinkled Web", American Roller Co., Bannockburn, Ill.

*Primary Examiner*—Robert R. Mackey

*Attorney, Agent, or Firm*—Quarles & Brady

[57] ABSTRACT

An improved stretcher/expander roller is disclosed. The roller includes a rigid core which is rotatably mounted downstream from where a traveling web is slit. An elastomeric covering around the core has at least one pair of helical lands formed in it which each spiral outwardly away from the center of the roller. The lands are inclined outwardly away from the center of the roller and progressively increase in flexibility from the center to the ends of the roller. The roller imparts axial forces on the web strips to simultaneously separate the web strips from one another and cross-stretch each web strip. The lands are made progressively more flexible by either progressively increasing the depth of the helical grooves between the lands, by progressively decreasing the helix angle of the lands, or by progressively decreasing the angle subtended by each land and the axis of the roller, from the center to the ends of the roller.

2 Claims, 7 Drawing Figures

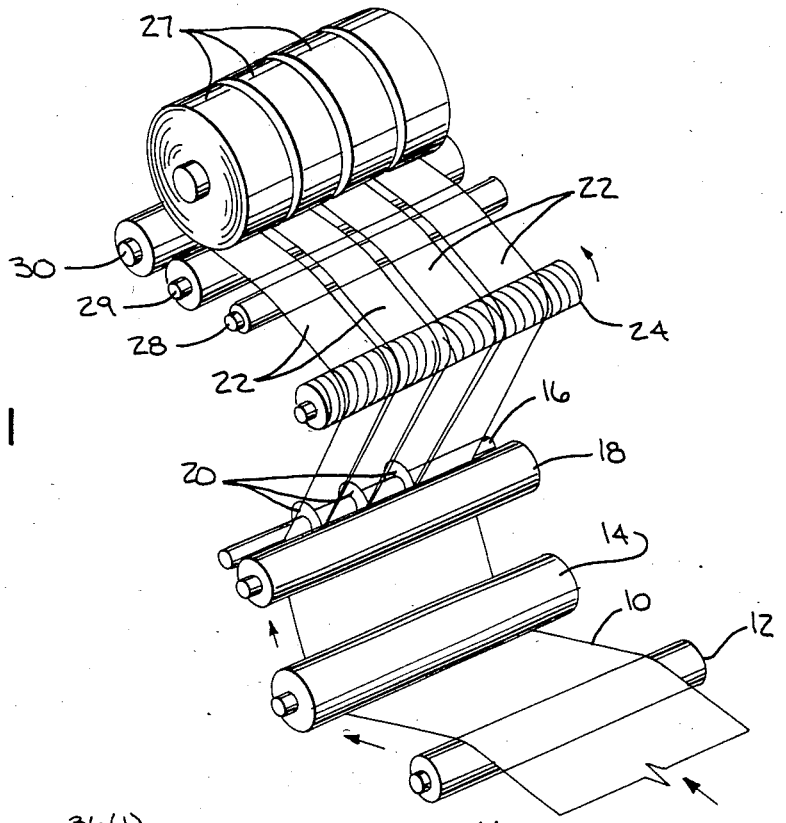
FIG. 1
FIG. 2
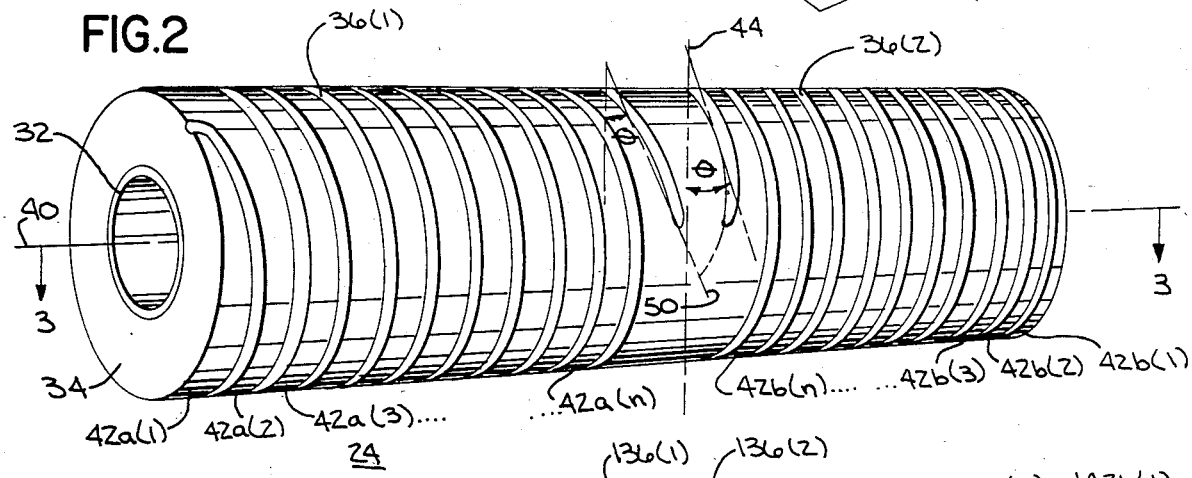
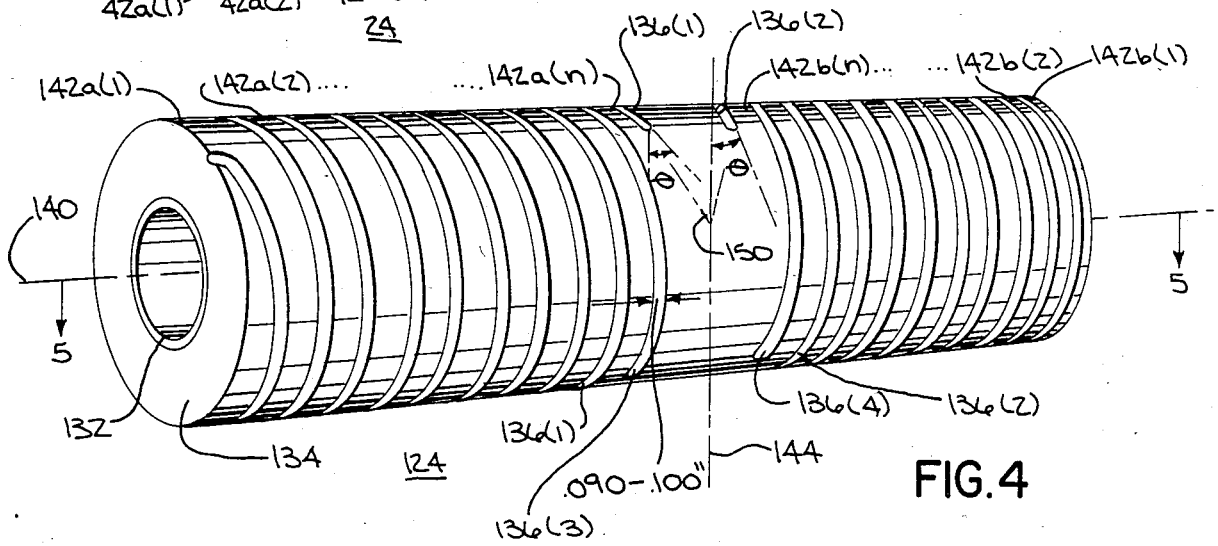
FIG. 4

STRETCHER/EXPANDER ROLLER

This application is a continuation of application Ser. No. 436,842, filed Oct. 26, 1982, now abandoned.

FIELD OF THE INVENTION

This invention relates generally to stretcher rollers for cross-stretching a moving web, and more particularly, this invention relates to an improved stretcher roller for cross-stretching and spreading the resulting strips of a moving web when the web is slit.

BACKGROUND OF THE INVENTION

When a moving web, such as paper, film, textile, foil or the like moves through a printing press or moves through processing machinery, the web often tends to wrinkle even though the web is usually supported by one or more rollers along its path of travel. Wrinkling of the web is generally undesirable as it usually impairs printing or processing of the web. Moreover, when the web is to be split into smaller constituent strips, wrinkles in the web may cause deviation in the strip size which may render the strips unsuitable for subsequent use.

To prevent web wrinkling, the web must be cross-stretched, that is to say, the web must be stretched perpendicular to the direction of web movement. Transverse or cross-stretching of the web has been accomplished in the past by use of a stretcher roller located along the path of web movement so as to be in contact with the web. Prior art stretcher rollers are typically configured of a rigid core which has an elastomeric covering. The covering is provided with either a single pair of spiral groove segments or a double pair of spiral groove segments of uniform depth and angle. The groove segments in the elastomeric cover of the roller create a plurality of ribs or lands which are separated from each other by one of the groove segments. As the web passes over the roller, the lands of the roller cover each exert a force on the web transverse to the direction of web movement to cross-stretch the web. The transverse stretching action of the roller lands keeps the web taut and wrinkle-free.

The disadvantage believed associated with present day stretcher rollers is that, although they are well suited for maintaining a single web taut, prior art stretcher rollers are generally not well suited for cross-stretching the individual strips which result when the web is slit. The cross-stretching force exerted by the lands of prior art stretcher/expander rollers tends to be uniform across the roller which does not readily facilitate simultaneous cross-stretching and separation of the constituent web strips following web slitting.

SUMMARY OF THE INVENTION

The invention provides a stretcher/expander roller which includes a rigid core which is rotatably mounted downstream from where a web is slit. An elastomeric covering around the core has at least one pair of helical lands formed in it which each spiral outwardly from the center of the roller. The lands are inclined outwardly away from the center of the roller and progressively increase in flexibility from the center to the ends of the roller. This arrangement imparts axial forces on the web strips to simultaneously separate the web strips from one another and cross-stretch each web strip.

The helical lands may be made progressively more flexible from the center to the ends of the roller in several different ways. One way is to progressively increase the depth of the helical groove between the lands from the center to the ends of the roller. Another way is to progressively decrease the slant or helix angle of the lands from the center to the ends of the roller. Yet another way is to progressively decrease the angle subtended by each land and the axis of the roller from the center to the ends of the roller.

BRIEF DESCRIPTION OF THE DRAWINGS

The features of the invention believed to be novel are set forth with particularity in the appended claims. The invention itself, however, both as to organization and method of operation, together with further objects and advantages thereof may best be understood by a reference to the following description taken in conjunction with the accompanying drawings in which:

FIG. 1 is a perspective view of a portion of web slitting apparatus which embodies the improved stretcher/expander roller of the present invention;

FIG. 2 is a perspective view of a preferred embodiment of an improved stretcher/expander roller constructed in accordance with the invention;

FIG. 4 is a perspective view of an alternate preferred embodiment of an improved stretcher/expander roller constructed in accordance with the present invention;

DETAILED DESCRIPTION OF THE PREFERRED EMBODIMENT

Figure 5:
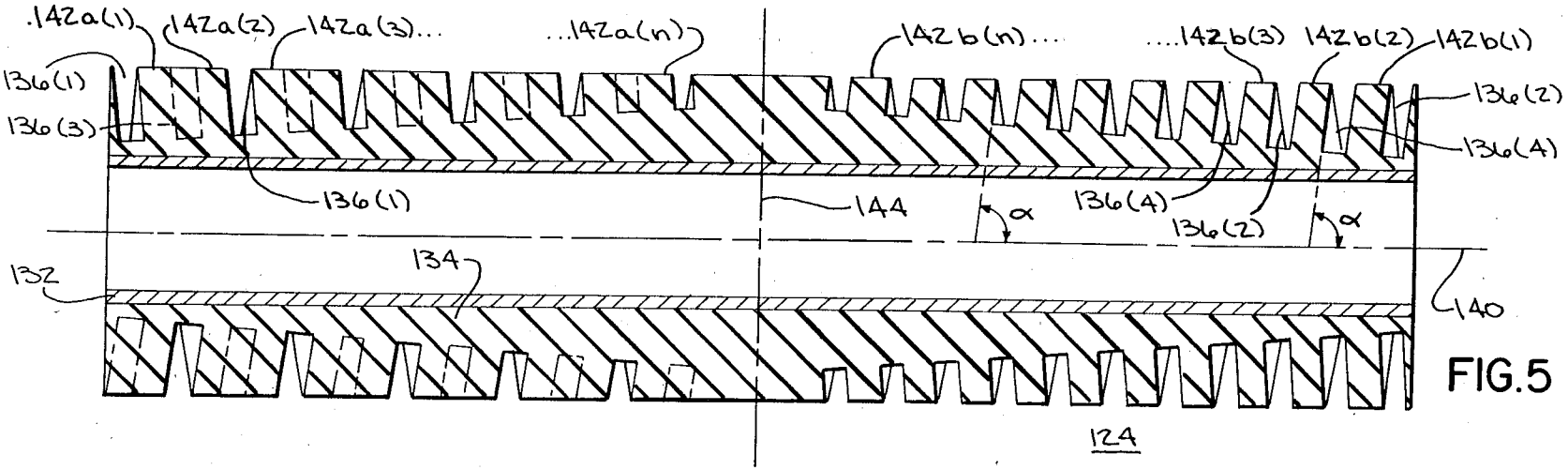
FIG. 5 is a cross sectional view of the roller of FIG. 4 taken along lines 5—5 thereof.

Referring now to the Figures, FIG. 1 is a perspective view of a portion of a web slitting machine for slitting a moving web 10 which may be paper, foil, film, textile or the like. In the web slitting machine illustrated in FIG. 1, web 10 is unrolled from a supply roll (not shown) and passes over guide roller 12 and underneath guide roller 14 before the web is urged against a slitter roller 16 by a guide roller 18. Slitter roller 16 carries one or more slitter knives 20 for slitting web 10 into constituent web strips 22. Although slitter roller 16 is shown in FIG. 1 as carrying three spaced-apart slitter knives 20 for slitting web 10 into four constituent strips, a greater or lesser number of slitter knives could be employed for slitting web 10 into the desired number of constituent strips 22.

Web strips 22 which result when web 10 is slit by slitter knives 20 of slitter roller 16 are simultaneously cross-stretched and separated by a novel stretcher/expander roller 24 which underlies the strips 22 downstream of slitter roller 16 so that the strips wrap about the roller. After the strips 22 wrap about the stretcher/expander roller 24, the strips are guided onto a separate one of take-up reels 27 by guide rollers 28 and 29. A tension roller 30 bears against the web strips as they are wound on their corresponding take-up rollers 27 to assure a tight wrap. Although not shown, drive means, taking the form of an electric motor, are provided for not only rotating take-up rollers 27 but for driving one or more of rollers 12, 14, 18, 28 and 29 as well as for driving slitter roller 16 and stretcher/expander roller 24.

Figure 3:
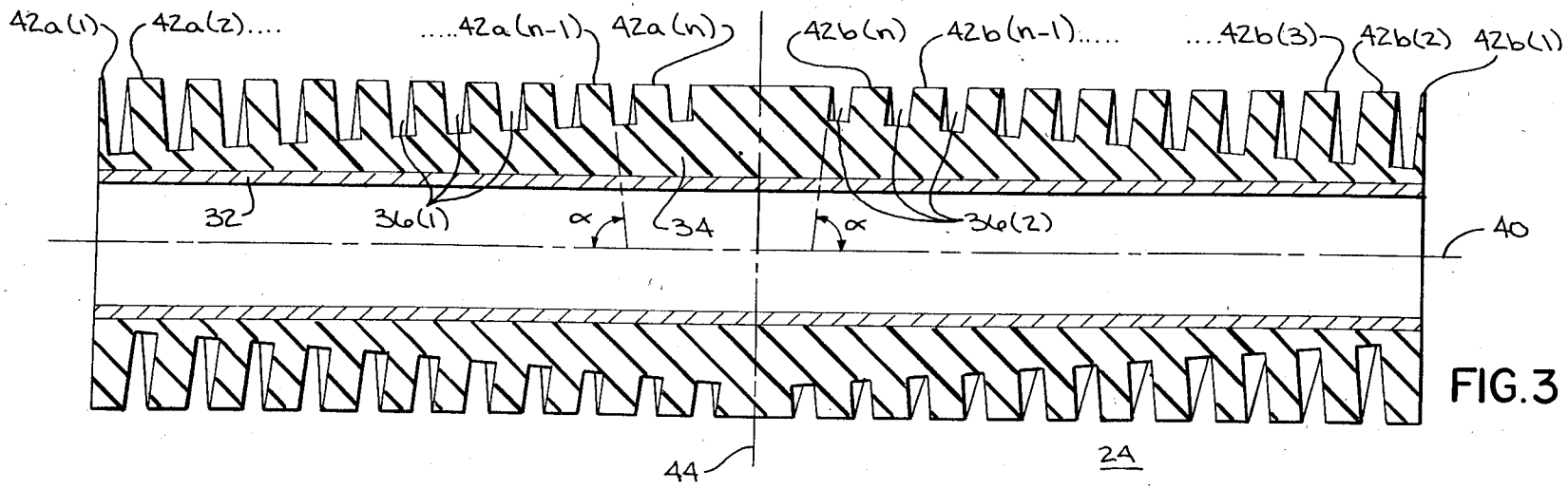
FIG. 3 is a cross sectional view of the roller of FIG. 2 taken along lines 3—3 thereof.

The stretcher/expander roller 24 of the present invention may be configured in several different ways so as to achieve simultaneous cross-stretching and separation of the constituent web strips upon slitting of a web. FIGS. 2 and 3 are perspective and cross sectional views, respectively, of one embodiment of stretcher/expander roller 24 of the present invention. Referring to those Figures, stretcher/expander roller 24 comprises a rigid inner core 32, typically made from steel or the like, which is covered with an elastomeric covering 34 of uniform diameter. Cover 34 is typically configured rubber or the like. The length of sleeve 32 and cover 34 and the thickness of the cover necessarily depend on the length and type of the web whose constituent strips are to be simultaneously cross-stretched and separated by stretcher/expander roller 24.

In the preferred embodiment of roller 24 illustrated in FIGS. 2 and 3, a pair of groove segments 36(1) and 36(2) are each disposed in the periphery of cover 34 so as to spiral oppositely from each other from the center line 44 of the cover to a separate one of the cover ends. In practice, each of grooves segments 36(1) and 36(2) is 0.09–0.200" (2.2–5.0 mm) wide as best illustrated in FIG. 3. As each groove segment spirals about the periphery of the roller cover from the roller center to the roller end, as illustrated in FIG. 2, each groove makes an angle $\theta$, referred to as the slant angle, with a line which moves parallel to the center line 44. The slant angle remains constant for each groove.

As groove 36(1) spirals from the roller center to the roller edge, the groove creates one continuous land which appears as a plurality of lands or cross stretching members **42*a*(1), 42*a*(2), 42*a*(3), . . . 42*a*(n) when viewed in cross section where n is an integer, such lands each being separated from an adjacent land by the groove. Likewise, groove 36(2) creates a plurality of lands 42*b*(1), 42*b*(2), 42*b*(3) . . . 42*b*(n), with each land separated from an adjacent land by the groove segment. Each of the grooves 36(1) and 36(2) is at an angle, referred to as the depth angle $\alpha$, with the roller axis 40. The depth angle $\alpha$ for each of grooves 36(1) and 36(2)** remains constant per groove revolution at a value less than 90°.

By making the depth angle $\alpha$ less than 90°, each land exerts a transverse or cross-stretching force against an overlying web strip as the web strip bears against the land. In addition, because each of grooves 36(1) and 36(2) spirals about the roller cover as the roller rotates, the screw-like motion of each groove tends to laterally push that part of the web strip falling into the groove. Usually most of the cross-stretching action results, however, from the transverse force exerted by the land rather than the lateral pushing force resulting from the screw-like motion of the groove. In order for the roller 24 of FIGS. 2 and 3 to effectively separate the web strips wrapped thereover, the roller is rotated so that the arrowhead 50 where each of groove segments 36(1) and 36(2) would intersect revolves with the web so that the lands each push the web strips towards the roller ends. Thus, in order for the roller 24 of FIGS. 2 and 3 to cross-stretch and separate the overlying web strips, the roller 24 of FIGS. 2 and 3 would rotate oppositely to the direction of rotation of roller 24 of FIG. 1 as it appears in that drawing.

To achieve the simultaneous separation and cross-stretching of the constituent web strips emanating from the web upon slitting, it is necessary to cross-stretch or laterally move the outermost web strips more than the innermost web strips. This is readily accomplished by the roller 24 illustrated in FIGS. 2 and 3 by progressively deepening each of groove segments 36(1) and 36(2) as each spirals from the center of the roller to each of the opposite ends of the roller. As is illustrated in FIG. 3, progressively deepening each of groove segments 36(1) and 36(2) as they spiral about the roller cover from the center of the roller to a separate one of the roller ends causes the length and hence bending moment of each of lands **42*a*(1), 42*a*(2), 42*a*(3) . . . 42*a*(n) and lands 42*b*(1), 42*b*(2), 42*b*(3) . . . 42*b*(n) to decrease in proportion to the distance from the center of each separate land to the roller center line 44. The bending moment of each land governs the flexibility of each land and hence the amount of transverse force exerted by each land against the overlying web strip as the web strip passes thereover. Thus, by making the depth of each of groove segments 36(1) and 36(2) progressively greater as each groove segment spirals about the roller cover from the roller center line 44 to a separate one of the roller edges, the amount of cross-stretching exerted by the lands 42*a*(1), 42*a*(2) and 42*a*(3) and 42*b*(1), 42*b*(2) and 42*b*(3) closest to each of the edges of the roller will be greater than the cross-stretching force exerted by lands 42*a*(n−1) and 42*a*(n) and 42*b*(n−1) and 42*b*(n) closest to the roller center. Progressively increasing the amount of cross-stretching exerted by the lands of roller 24** achieves greater separation of the web strips than is achieved by prior art spreader/expander rollers whose lands are of uniform flexibility so as to uniformly cross-stretch the web strips. Good separation of the web strips is very important where a large number of constituent web strips result from a slit web. Little or no separation of the web strips may result in tangling of the web strips which is very undesirable.

In practice, the depth of each of the grooves 36(1) and 36(2) increases linearly per revolution of the groove as each groove spirals from the center of the roller to a separate one of the roller edges. In certain applications, however, it may be desirable to dimension each of grooves 36(1) and 36(2) so that the depth of each groove increases logarithmically per groove revolution as each groove spirals from the roller center to a separate one of the roller edges.

An alternate embodiment 124 of an improved stretcher/expander roller for simultaneously cross-stretching and separating the constituent web strips of a slit web is illustrated in FIGS. 4 and 5. Roller 124 of FIGS. 4 and 5 is comprised of a rigid core 132 which is circumscribed by an elastomeric cover 134 of uniform diameter. Although roller 124 as illustrated in perspective in FIG. 4 may appear very similar to roller 24 of FIG. 3, roller 124 of FIGS. 4 and 5 differs from roller 24 of FIG. 4 in the following respect. Instead of having a single pair of oppositely spiraled grooves disposed in the cover as has roller 24 of FIGS. 2 and 3, roller 124 has two pairs of opposing spiral grooves 136(1), 136(2), 136(3) and 136(4). Grooves 136(1) and 136(2) are each disposed in the cover so as to spiral oppositely to each other from the center of the roller to a separate one of the roller ends. Each of the grooves 136(3) and 136(4) is spirally disposed in the roller cover so as to be intertwined with a separate one of spiral grooves 136(1) and 136(2), respectively.

To better understand how grooves 136(3) and 136(4) are intertwined with a separate one of grooves 136(1) and 136(2), reference should be had to FIG. 5 which is a cross-sectional view of roller 124. The left-hand side of roller 124 of FIG. 5 has but a single groove 136(1) cut therein with the second groove 136(3) shown in phantom whereas the right-hand side of roller 124 of FIG. 5 has both grooves 136(2) and 136(4) cut therein so that groove 136(4) is shown in between, so as to be intertwined with, groove 136(2). The depth angle $\alpha$ of each of the grooves remains constant at less than 90°.

As grooves 136(1) and 136(3) and grooves 136(2) and 136(4) each spiral from the roller center to a separate one of the roller edges, the grooves create continuous lands which when viewed in cross section appear as a plurality of lands 142*a*(1), 142*a*(2), 142*a*(3) . . . 142*a*(n) and lands 142*b*(1), 142*b*(2), 142*b*(3) . . . 142*b*(n), respectively, where n is an integer. Grooves 136(1), 136(2), 136(3) and 136(4) are each of progressively increasing depth per groove revolution from the roller center to a separate one of the roller edges so that lands 142*a*(1), 142*a*(2), 142*a*(3) . . . 142*a*(n) and lands 142*b*(1), 142*b*(2), 142*b*(3) . . . 142*b*(n) are of progressively decreasing flexibility so that the lands closest to the roller edges exert a greater cross-stretching movement than do those at the roller center.

The advantage of the double split groove roller 124 is that thin web material, such as plastic, is not drawn into the groove segments nearly to the same extent as would be the case with the single split groove roller 24 of FIGS. 2 and 3. Grooves 136(1) and 136(2) have an increased slant angle $\theta$ as compared to grooves 36(1) and 36(2) of roller 24 in FIGS. 2 and 3 which, as will become better understood, tends to make the radial span across the groove shorter and the lands wider, so that less of the web falls into the groove segment. Since a wider land is less flexible, each of groove segments 136(3) and 136(4) is intertwined with a separate one of grooves 136(1) and 136(2), respectively, so as to effectively decrease the width of the land without increasing the effective area of the underlying groove segment.

In order for roller 124 to cross-stretch and separate the constitutent web strips (not shown) wrapped about the roller, the direction of roller 124 rotation is such that the arrow lead 150 formed by the imaginary intersection of groove segments 136(1) and 136(2) moves with the direction of web movement. Thus, the direction of rotation of roller 124 of FIGS. 4 and 5 would be opposite to the direction of rotation of roller 24 in FIG. 1 as shown in that drawing.

Figure 6:
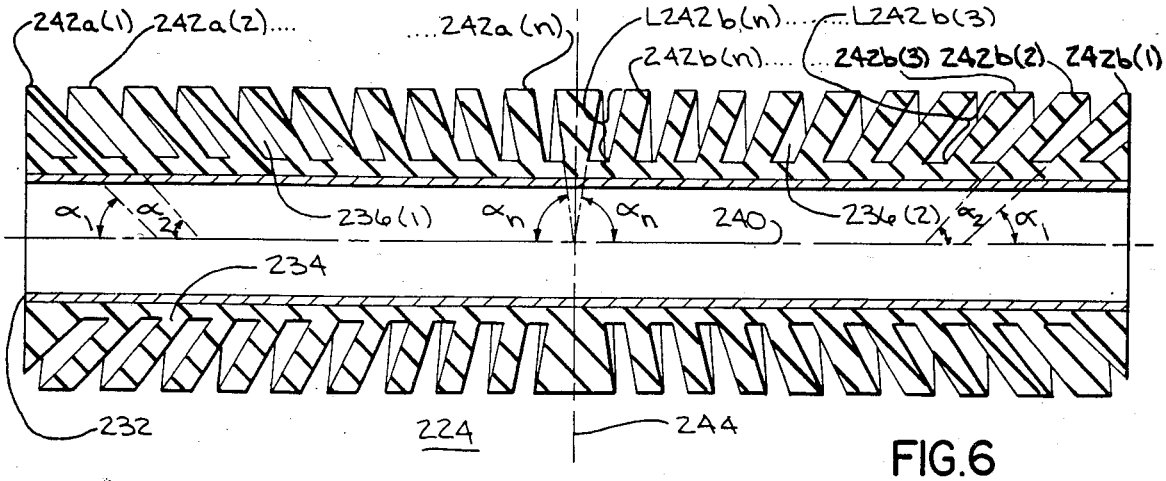
FIG. 6 is a cross-sectional view of another alternate preferred embodiment of an improved stretcher/expander roller constructed in accordance with the present invention.

Yet another alternate preferred embodiment 224 of a stretcher/expander roller of the present invention is illustrated in cross section in FIG. 6. Roller 224 comprises a rigid core 232 circumscribed by an elastomeric cover 234. Like roller 24 of FIGS. 2 and 3, roller 224 of FIG. 6 has a pair of grooves 236(1) and 236(2) disposed in elastomeric cover 234 so as to spiral in opposite directions from the roller center to a separate one of the roller edges.

The spiral grooves 236(1) and 236(2) in cover 234 create continuous lands which appear as a plurality of lands 242*a*(1), 242*a*(2), 242*a*(3) . . . 242*a*(n) and lands 242*b*(1), 242*b*(2), 242*b*(3) . . . 242*b*(n), respectively when viewed in cross section, where n is an integer. Each land is separated from an adjacent land by a separate one of the groove segments. Unlike each of grooves 36(1) and 36(2) in roller cover 34 of roller 24 illustrated in FIGS. 2 and 3 which are each at a constant depth angle $\alpha$ with the roller axis 40, each of the grooves 236(1) and 236(2) is disposed in cover 234 so that the depth angle $\alpha$ which the groove segment makes with the roller axis 240 progressively decreases per groove revolution as each groove segment spirals about the roller from the roller center line 244 to a separate one of the roller ends. As illustrated, the depth angle $\alpha_1$ associated with each of lands 242*a*(1) and 242*b*(1) is less than $\alpha_2$, the depth angle associated with lands 242*a*(2) and 242*b*(2) which is less than the depth angle associated with each of lands 242*a*(3) and 242*b*(3) and so on. Thus, $\alpha_1<\alpha_2<\alpha_3<\alpha_n<90°$. By dimensioning the groove segments so that the depth angle $\alpha$ progressively decreases per groove revolution as each groove spirals from the roller center line 244 to each of the roller edges, then the length of each L242 is such that L242*a*(1)>L242*a*(2)>L242*a*(3)> . . . L242(*n*) and L242*b*(1)>L242*b*(2)>L242*b*(3)> . . . L242*b*(*n*).

The bending moment of each of the lands is proportional to the length of the land. The greater the land length, the greater the bending moment and hence the greater the amount of cross-stretching force exerted by the land against an overlying web strip (not shown). Since the lands 242*a*(1), 242*a*(2), 242*a*(3) . . . 242*a*(*n*) and lands 242*b*(1), 242*b*(2), 242*b*(3) . . . 242*b*(n) are of progressively decreasing length, it follows that the lands are of decreasing flexibility from the roller edge to the roller center so that the lands closest to the roller edge exert a greater cross-stretching force against an overlying web strip than do the lands closes to the roller center line.

Figure 7:
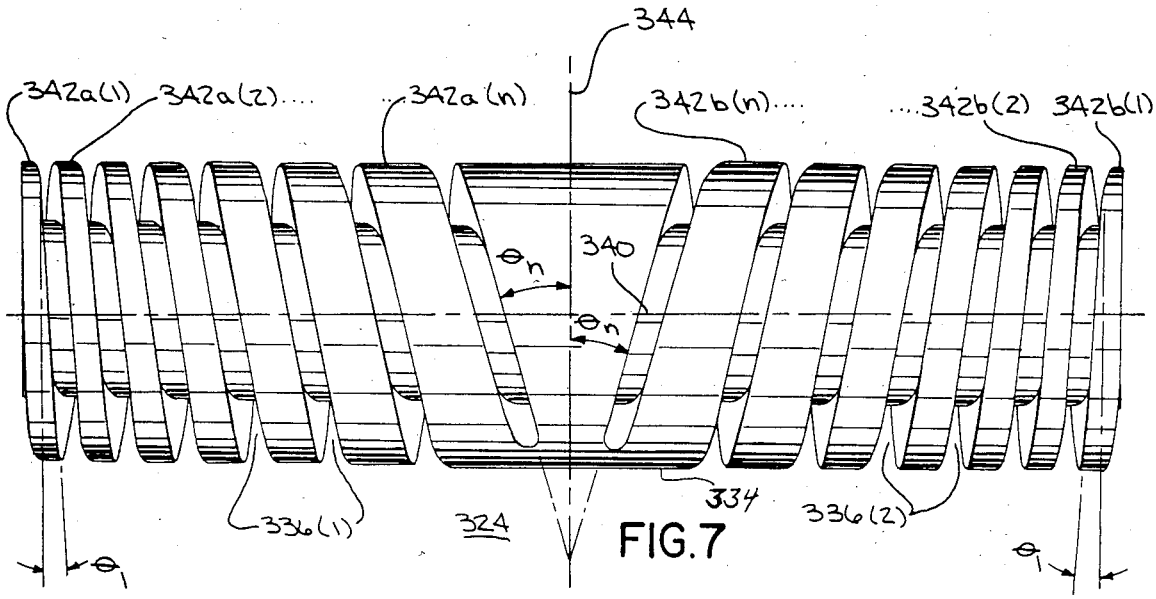
FIG. 7 is a frontal view of yet another stretcher/expander roller constructed in accordance with the present invention.

Yet another alternate preferred embodiment 324 of an improved stretcher/expander roller for simultaneously cross-stretching and separating a plurality of constituent web strips following web slitting is illustrated in FIG. 7. Roller 324 of FIG. 7, like rollers 24 of FIGS. 2 and 3, roller 124 of FIGS. 4 and 5, and roller 224 of FIG. 6, is comprised of a steel core (not shown) circumscribed by an elastomeric cover 334.

The elastomeric cover 334 of roller 324 has a pair of grooves 336(1) and 336(2) disposed therein with each groove spiraling oppositely to the outer groove from the roller center to a separate one of the roller edges. Groove 336(1) creates a continuous land which appears as a plurality of lands 342*a*(1), 342*a*(2), 342*a*(3) . . . 342*a*(n) when viewed in cross section while groove 336(2) creates lands 342*b*(1), 342*b*(2), 342*b*(3) . . . 342*b*(n), each land separated from an adjacent land by one of the pair of grooves. Unlike roller 24 of FIGS. 2 and 3 whose grooves each make a constant slant angle $\theta$ with a line moving parallel to the roller center line 44, each of grooves 336(1) and 336(2) is disposed in roller cover 334 such that the slant angle $\theta$ between each groove segment and a line moving parallel to center line 344 progressively decreases as each groove spirals from the roller center line to a separate one of the roller ends. Although not shown, the depth angle $\alpha$ associated with each groove segment remains constant at less than 90°. As can be observed from FIG. 7, by configuring the grooves 336(1) and 336(2) such that the slant angle between each groove segment and the roller axis 340 progressively decreases per groove segment revolution as the grooves each spiral from the roller center to a separate one of the roller edges, the width of lands 342*a*(1), 342*a*(2), 342*a*(3) . . . 342*a*(n) progressively decreases as does the width of lands 342*b*(1), 342*b*(2) 342*b*(3) . . . 342*b*(n) per groove revolution. The width of each land is inversely proportional to the bending moment of each land so that the narrower the land, the greater the bending moment. Since the bending moment of each land is directly proportional to the flexibility of the land and hence the amount of cross-stretching or lateral movement exerted by the land against an overlying web strip (not shown), the narrower the land, the greater the cross-stretching or lateral movement exerted by the land against the overlying web strip. Thus, configuring each of the grooves such that the slant angle $\theta$ associated with each groove segment progressively decreases per groove revolution, as each groove spirals from the roller center to a separate one of the roller edges, causes the slant angle $\theta_1$ of that portion of the groove 336(1) separating lands **342*a*(1) and 342*a*(2) (which is equal to the slant angle $\theta_1$ of that part of groove 336(2) separating lands 342*b*(1) and 342*b*(2)) to be less than the respective slant angle $\theta_2$ of the groove segments 336(1) and 336(2) separating lands 342*a*(2) and 342*a*(3), and lands 342*b*(2) and 342*b*(3), respectively, and so on. Thus, $\theta_1<\theta_2<\theta_3<\theta_4 \ldots <\theta_n$. The proportionately decreasing slant angle $\theta$ of each groove segment as each groove segment spirals from the roller center to a separate one of the roller edges causes the width of lands 342*a*(1), 342*a*(2), 342*a*(3) . . . 342*a*(n) and the width of lands 342*b*(1), 342*b*(2) 342*b*(3) . . . 342*b*(n)** to progressively increase. Since the land width is inversely proportional to the bending moment of the land, and hence the amount of cross-stretching or lateral movement exerted by the land against an overlying web strip, the narrower lands near the ends of the roller exert a greater cross-stretching or lateral movement than do the wider lands near the roller center.

The foregoing discloses an improved stretcher/expander roller for simultaneously cross-stretching and separating constituent web strips passing over the roller following web slitting. The simultaneous cross-stretching and separating action of the roller is accomplished by configuring the roller of an elastomeric member having one or more grooves therein such that the land or ribs between the groove(s) are of increasing flexibility from the roller center to the roller edge to impart a greater cross-stretching to the overlying webs at the roller edges than the webs at the roller center.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

What I claim is:

1. A stretcher/expander roller for cross-stretching and separating the constituent strips of a slit web, comprising:

(a) a rigid inner core suitable to be rotationally mounted downstream from where the web is slit; and (b) an elastomeric covering around said rigid core, said elastomeric covering defining a generally cylindrical exterior surface having a constant outer diameter and which is suitable for rolling contact with the slit web;

(c) wherein at least one pair of helical grooves are formed in the exterior surface of the elastomeric covering, each of said helical grooves subtending a slant angle $\theta$ with a line which is perpendicular to the roller axis and each of said grooves spiraling outwardly away from the center of the roller;

(d) wherein the helical grooves are inclined outwardly at an acute depth angle $\alpha$ away from the center of the roller, said depth angle $\alpha$ being constant from the center of the roller to the ends and said helical grooves defining a corresponding number of continuous helical lands of elastomeric material which are inclined outwardly away from the center of the roller at said acute depth angle $\alpha$; and (e) wherein the depth of each helical groove increases progressively from the center to the adjacent edge of the roller so that the lands are increasingly flexible from the center to the ends of the roller.

2. A stretcher/expander roller as in claim 1, wherein a plurality of helical grooves are formed in each side of the roller.

* * * * *